United States Patent [19]

Schilling et al.

[11] 4,082,160

[45] Apr. 4, 1978

[54] SILENCER FOR EXHAUSTING GAS STREAMS

[75] Inventors: Hermann Schilling, Weinheim; Heinz Seifert, Mannheim, both of Germany

[73] Assignee: Firma Carl Freudenberg, Weinheim, Germany

[21] Appl. No.: 674,994

[22] Filed: Apr. 8, 1976

[30] Foreign Application Priority Data

Apr. 16, 1975 Germany ..... 2516626

[51] Int. Cl.[2] ..... F01N 1/08; F01N 1/00; F01N 3/06

[52] U.S. Cl. ..... 181/258; 181/230; 181/256; 181/267

[58] Field of Search ..... 181/36 A, 50, 55, 69, 181/71, 230, 256, 258, 267

[56] References Cited

U.S. PATENT DOCUMENTS

| | | | |
|---|---|---|---|
| 2,764,250 | 9/1956 | Jeffords | 181/36 A |
| 3,009,531 | 11/1961 | Mead | 181/36 A |
| 3,688,870 | 9/1972 | Gibel | 181/50 |
| 3,715,010 | 2/1973 | Gibel | 181/36 A |
| 3,882,961 | 5/1975 | Cannan et al. | 181/50 |

*Primary Examiner*—Stephen J. Tomsky
*Attorney, Agent, or Firm*—Burgess, Dinklage & Sprung

[57] ABSTRACT

A silencer for reducing the noise of an exhausting gas stream, comprising a hollow body having a connector, a sound-absorbing insert in the body and an inner component, the sound-absorbing insert comprising at least one split sheet of closed-pore foamed plastic material having a thickness of less than its average pore-size. Advantageously the sheet material comprises closed-pore cross-linked foamed polyethylene stacked or wound to provide about 3 to 30 layers, each layer ranging in thickness from about 0.1 to 1.0 mm, having an average pore diameter from about 0.2 to 2 mm and an air permeability from about 0.5 to 200 Rayl, the air permeability of the innermost layer ranging from about 1 to 4 times the air permeability of the outermost layer.

12 Claims, 3 Drawing Figures

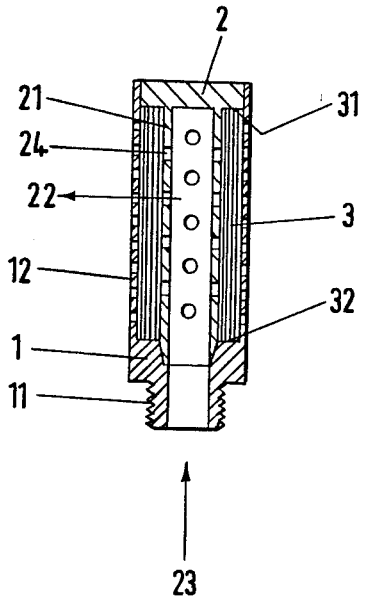
FIG.I.
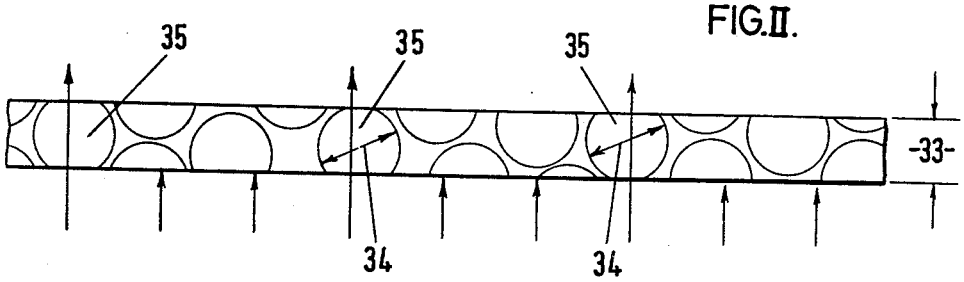
FIG.II.
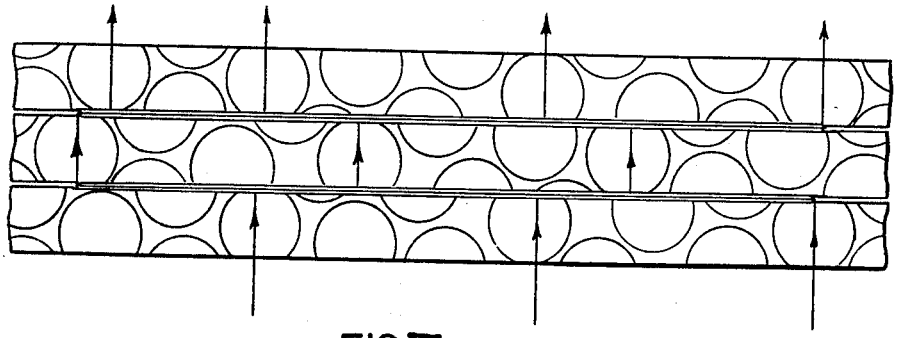
FIG.III.

SILENCER FOR EXHAUSTING GAS STREAMS

This invention relates to silencers for reducing the blow-out noises of gas streams, for use for example with compressed air valves. The silencers are of the kind comprising a hollow body having a connector, a sound-absorbing insert in the body and an inner component. In compressed air valves, venting connections are frequently provided with such silencers, because the expanding compressed air produces loud noises.

The usual effect of such silencers is that an initially sharply beamed air jet is passed through a mass of porous material by which it is diffused in a stream of large cross-section. Thus there is a reduction in the air speed and thus also in the noise production, this being in the ratio of the cross-sectional area of the air jet to the free passage area of the porous material. A prerequisite for this however is that there should be a uniform distribution of the air flow across the larger cross-section. In very finely porous material, this is achieved even with fairly small thicknesses of material but with coarsely porous material it is only achieved by a correspondingly increased thickness of material, since all materials are traversed in a more or less linear manner. This applies equally to sintered materials of metal or polyethylene powder, to open-pore foam, and to felt.

It follows from this that, for an equivalent degree of sound absorption, silencers comprising finely porous inserts can be smaller than silencers having coarsely porous inserts. It should however be remembered that finely porous inserts produce undesired throttling of the air flow if they are even slightly dirty or oily.

Existing forms of the insert consist of a rolled up sheet of wire mesh and a cartridge of air-permeable, porous foam material.

Both these inserts have basically an open-pore character and it is from this that their disadvantages result. If they are finely constructed, both are sensitive to fouling and oiling up, and they are therefore restricted to being of substantial size.

The aim of the present invention is to provide a silencer of the kind described when even when made of smaller size than is customary still has good sound-absorption properties and is not easily fouled or oiled up.

To this end, according to this invention, the sound-absorbing insert of such a silencer is made of one or more split sheets of closed-pore foamed plastics material, the thickness of the, or each, split sheet being less than its average pore size.

The degree of sound-absorption and the resistance to fouling can be improved by forming the insert with a number of layers formed by superimposed sheets or sheets wound in layers. The sheets may have differing air permeabilities from each other. The air permeability of the insert may be uniform from one side to the other, or may increase or decrease. Particularly outer layers may have a lower air permeability than inner layers.

The resistance to fouling and oiling-up of a silencer made in accordance with the invention may be substantially better than that of existing silencers of the same kind. In tests, a high dirt loading with oil and floating particles of a stream of air passing through the silencer resulted neither in a clear reduction in the sound absorption nor in a clear increase in the throttling effect of the silencer. This means that the insert has a self-cleaning action. Washing out of the sound-absorbing insert thus becomes superfluous and its operating life is improved.

The reason for this is that in a sound absorbing insert in accordance with the invention, an appreciable portion of the pores have gas regularly flowing across them but not through them. These are those pores which are cut open on one side as the sheet is sliced. Foreign substances such as oil and dirt are precipitated preferentially in these voids, through which there is no flow. The solid constituents do not however form permanent encrustations there. Instead, as further air flows past, these substances are swept out again and are carried out by the air flow through those large pores which are cut open on both sides as the sheet is sliced. The very large difference in volume of the pores cut open on one side also has an energy dissipating and balancing effect upon the air flowing past them. Preferably, the sheet or sheets are of a cross-linked polyolefin, for example polyethylene.

The insert may be supported externally by an air-permeable plate or sleeve forming part of the body. It may also surround a radially perforated tube, which forms the inner component, the total area of the perforations being greater than the cross-sectional area of the tube.

An example of a silencer in accordance with the invention will now be described with reference to the accompanying drawings in which:

FIG. 1 is a longitudinal section through the silencer;

FIG. 2 is a cross-section to a much larger scale through a split sheet of closed-pore foamed plastic material from which the insert of the silencer is made; and FIG. 3 is a section through the insert which consists of a number of sheets as shown in FIG. 2.

The silencer has a body 1 which is a molding of metal or plastic material and has a screw-threaded connector portion 11 and an air-permeable perforated cage portion 12.

An inner component 2 is screwed into the body 1 and a sound absorbing insert 3 is clamped in a sealing manner between axially facing surfaces 31 and 32 of the inner component and the body respectively.

An important feature of the inner component 2 is the permeability to air of a perforated tubular part 21 of the component 2. This must be greater in the radial direction 22 than in the axial direction 23, and the perforations 24 should be uniformly distributed over its surface.

Referring to FIG. 2, the thickness 33 of the split sheet is less than the average pore diameter 34. The result is that a portion of the pores 35 are cut open on both sides, so that the sheet becomes permeable to the air. For a given pore size, the degree of permeability to air can be determined by the sheet thickness 33. It is however also possible, for a predetermined sheet thickness, to determine the permeability to air by an intentional adjustment of the pore size.

Referring to FIG. 3, it will be evident that the air flowing through the insert is compelled to flow in a meandering manner, whereby the distance travelled by the air in its passage through the insert is considerably greater than the thickness of the insert and also considerably greater than with conventional inserts of the same thickness. To achieve a predetermined sound absorption characteristic, a small total thickness of the insert is therefor sufficient, in spite of the relatively large pores.

The advantages obtained by the invention consist particularly in that the silencer achieves a predetermined reduction in noise for a smaller overall size than conventional silencers of the same kind, and that it is considerably more insensitive to oil and dirt.

The thickness of the sheets generally ranges from about 0.1 to 1 mm and preferably from about 0.4 to 0.6 mm and the pores generally average from about 0.2 to 2 mm and preferably from about 0.8 to 1.2 mm in diameter. The ratio of average pore diameter to sheet thickness generally ranges from 1.5:1 to 3:1. As employed hereinabove, the average pore diameter can be determined approximately by a measuring microscope, by applying to the sheet surface a measured amount of liquid and seeing how much surface area is moistened, or equivalent known procedures. The sheets may range in air permeability from about 0.5 to 200 Rayl and preferably from about 4 to 10 Rayl, determined according to DIN52213.

Advantageously the number of superposed layers of sheets is from about 3 to 30, generally from about 6 to 15. Their air permeabilities may be approximately equal or the innermost layer may be of higher permeability than the outermost, e.g. about twice as high and possibly about four or more times as high.

While the preferred material is polyethylene, polypropylene, other polyolefins and other polymer foams also may be used. If the polymer is not already cross-linked as formed, it may have been cross-linked with dicumyl peroxide or other equivalent peroxides, by radiation, or the like.

A preferred embodiment is described in the following example:

EXAMPLE

A silencer as shown in FIG. 1 is provided for an exhaust gas outlet having an internal radius of about 6 mm. There are provided 7 layers of a cross-linked polyethylene foam sheet having a thickness of 0.5 mm, an average pore diameter of 1 mm and an air permeability at 6 bars of 1.5 $m^3$/minute. The outside diameter of the insert was 17 mm and its length in axial direction was 40 mm. Provision of the silencer reduced the noise level 1 meter from the gas outlet from an original level of 104 decibels to 75 decibels.

It will be appreciated that the instant specification and examples are set forth by way of illustration and not limitation, and that various modifications and changes may be made without departing from the spirit and scope of the present invention.

What we claim is:

1. A silencer for reducing the noise of an exhausting gas stream, comprising a body having a connecter portion and an air permeable portion, a sound-absorbing insert in the body and an air permeable inner component, the sound-absorbing insert comprising at least one split sheet of closed-pore foamed plastic material having a thickness of less than its average pore-size.

2. A silencer according to claim 1, in which the sheet is a closed-pore foamed polyolefin.

3. A silencer according to claim 1, in which the sheet is a cross-linked foamed polyolefin.

4. A silencer according to claim 2, in which the polyolefin is polyethylene.

5. A silencer according to claim 1, in which the insert has a number of layers formed by superimposed sheets.

6. A silencer according to claim 5, in which the sheets are of different air permeabilities from each other, the outermost layer having a lower air permeability than the innermost layer.

7. A silencer according to claim 1, in which the insert is supported externally by the air-permeable portion comprising a plate or sleeve.

8. A silencer according to claim 1, in which the insert surrounds a radially perforated tube which forms the air permeable inner component, the total area of the perforations being greater than the cross-sectional area of the tube.

9. A silencer according to claim 8, in which the sheet comprises closed-pore cross-linked foamed polyethylene, about 3 to 30 layers being provided, each layer ranging in thickness from about 0.1 to 1.0 mm, having an average pore diameter from about 0.2 to 2 mm and an air permeability from about 0.5 to 200 Rayl, the air permeability of the innermost layer ranging from about 1 to 4 times the air permeability of the outermost layer.

10. A silencer according to claim 9, about 6 to 15 layers being provided, each layer ranging in thickness from about 0.4 to 0.6 mm, having an average pore diameter from about 0.8 to 1.2 mm and an air permeability from about 4 to 10 Rayl, the air permeability of the innermost layer ranging from about 1 to 2 times the air permeability of the outermost layer.

11. A silencer according to claim 1, in which the insert has a number of layers formed by a sheet wound in layers.

12. A silencer according to claim 11, in which the sheets are of different air permeabilities from each other, the outermost layer having a lower air permeability than the innermost layer.

* * * * *